United States Patent [19]

Hawkings

[11] Patent Number: 4,619,490

[45] Date of Patent: Oct. 28, 1986

[54] GUIDANCE AND RETENTION DEVICE AND CONNECTOR ASSEMBLY

[75] Inventor: Robert M. Hawkings, San Mateo, Calif.

[73] Assignee: Raychem Corporation, Menlo Park, Calif.

[21] Appl. No.: 683,757

[22] Filed: Dec. 18, 1984

[51] Int. Cl.[4] ..... H01R 29/00

[52] U.S. Cl. ..... 339/31 M; 339/17 LM; 339/176 MP

[58] Field of Search ..... 339/31 R, 31 M, 31 B, 339/136 M, 176 MF, 176 MP, 17 N, 17 M, 17 LM, 217 S, 176 M, 210 R, 210 M, 206 R

[56] References Cited

U.S. PATENT DOCUMENTS

| | | | |
|---|---|---|---|
| 3,264,525 | 8/1966 | Swengel et al. | 339/17 LM |
| 3,476,982 | 11/1969 | Bell et al. | 339/17 M |
| 4,437,717 | 3/1984 | Korzik et al. | 339/17 M |

*Primary Examiner*—Gil Weidenfeld
*Assistant Examiner*—Paula A. Austin
*Attorney, Agent, or Firm*—Ira David Blecker; James W. Peterson

[57] ABSTRACT

A guidance and retention device for terminated connector wafers having a housing and at least one pair of opposed wafer retention members, said members releasably secured to opposed walls of the housing to provide for the guidance and retention of rectangular-shaped connector wafers therebetween. The unique wafer retention members are easily relocated to allow for reorganization of connector wafers and of a wiring array.

20 Claims, 4 Drawing Figures

GUIDANCE AND RETENTION DEVICE AND CONNECTOR ASSEMBLY

BACKGROUND OF THE INVENTION

1. Field of the Invention

This invention relates to electrical connectors and more particularly to a device for organization, guidance and retention of electrical connector wafers.

2. Description of the Prior Art

In the past, electrical connectors have utilized rectangular shaped connector wafers, the wafers being terminated to flat conductor cable or to individual round wires, wherein the wafers contained a multiple of electrical contacts in a straight line array. These wafers are brought together in a connector housing which is generally of rectangular crosssection having parallel transverse faces joined at perpendicular sides. A wafer is inserted therein in an axial direction to form a connector half assembly. The wafer is typically a flat, rigid plastic insert with contacts assembled or molded therein. The contacts may be either pins or sockets extending in the axial direction. A typical connector arrangement is disclosed in commonly-assigned U.S. Pat. No. 3,993,394, incorporated herein by reference. Such a connector is useful for interconnecting organized wiring systems wherein the relationship of the wafers to each other is fixed and nonvariable.

In complex wiring arrangements such as those present in modern aircraft, centralized connection points having a grid or network of electrical connections are highly desirable. These connection points are commonly called interface units. These units contain a plurality of contacts, the location of each contact being associated with a function of a device in the aircraft. It is highly desirable to removably and variably interconnect conductor wafers with such an interface unit in a variable fashion without having to rewire the individual conductors associated with the conductor wafers. This invention is a device which provides for the guidance and retention of rectangular shaped connector wafers, terminated to flat conductor cable or to individual round wires, the wafers containing a multiple of electrical contacts in a straight line array. The device incorporates wafer retention members which are releasably secured in a housing of appropriate design. The device allows one to easily organize in one or more rows an otherwise disorganized, labor-intensive wiring scheme typical in today's commercial or military aircraft.

SUMMARY OF THE INVENTION

The purpose of the invention is to provide means to organize a multi-conductor wiring scheme. To accomplish this purpose, a guidance and retention device is provided having a housing and at least one pair of opposed wafer retention members.

In one aspect of the invention, a guidance and retention device is provided having a guidance and retention device comprising:

a housing having an opening therethrough and having first and second operatively interconnected opposed and generally parallel walls; and at least one pair of wafer retention members located within said opening, one member releasably connected to said first opposed wall and the other member releasably connected to said second wall, each member having a plurality of guidance portions and retention portions, said guidance portions capable of guiding conductor wafers that may be inserted in stacked relationship into the housing and the retention portions capable of individually releasably securing conductor wafers within the housing.

Another aspect of the invention is a connector assembly comprising:

at least one connector wafer, said wafer being generally flat and having a plurality of axially extending contacts contained therein;

a housing having an opening therethrough and having first and second operatively interconnected opposed and generally parallel walls; and at least one pair of wafer retention members located within said opening, one member releasably connected to said first opposed wall and the other member releasably connected to said second wall, each member having a plurality of guidance portions and having wafer retention portions, said wafer(s) releasably secured within said housing between said members, guided by said guidance portions and retained by said retention portions.

DESCRIPTION OF THE PREFERRED EMBODIMENT

The invention is a device which provides for the guidance and retention of generally rectangular-shaped connector wafers in a stacked relationship, the wafers being terminated to flat conductor cable and/or to individual round wires. The wafers contain a multiple of electrical contacts generally in a straight line array. The device includes pairs of releasable, opposed wafer retention members. The device is modular in design and utilizes unique wafer retention members having upper and lower hold-down tabs which secure the members to the housing walls and which allow back-to-back assembly on a common housing wall, thus maximizing the use of available space. Further, one of the hold-down tabs designated the upper hold-down tab incorporates a spring member which expands and then retracts to grip a housing wall during operation of the device. This unique feature precludes the need for additional fastening.

Figure 1:
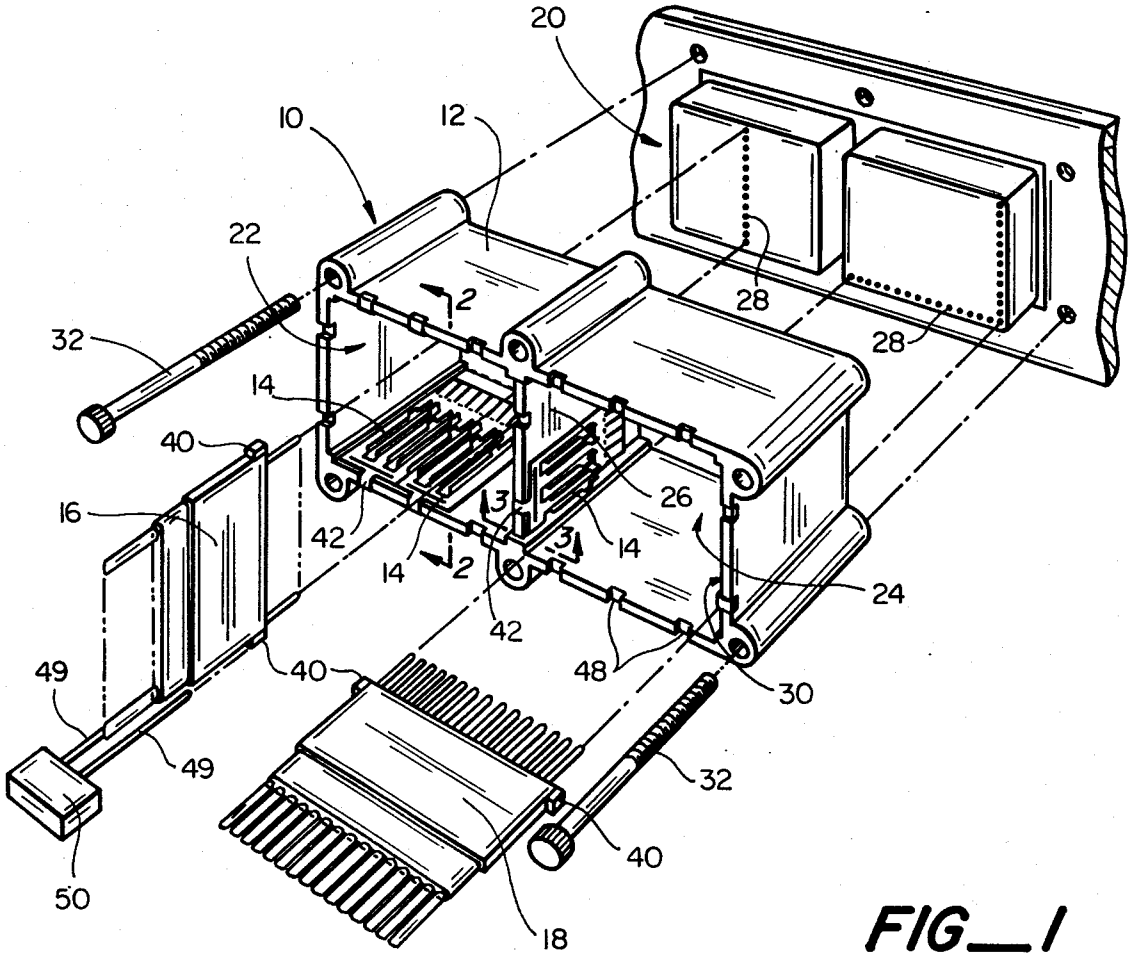
FIG. 1 is an exploded perspective view of a connector assembly utilizing a guidance and retention device in accordance with the instant invention. A wafer release tool is also illustrated in this Figure.

With continued reference to the drawing, FIG. 1 illustrates a typical assembly showing the accommodation of various wafer sizes and arrangements. Specifically, FIG. 1 illustrates the guidance and retention device of the instant invention shown generally at 10. The device comprises housing 12 and removable wafer retention members 14. Also illustrated are conductor wafers 16 and 18 (shown for purposes of illustration to be of different sizes) and a typical interface unit shown generally at 20.

Housing 12 is shown to be generally rectangular in shape having at least one opening therethrough. As illustrated, housing 12 is divided into two cavities 22 and 24 by an internal common housing wall 26. It is within the scope of the invention to have additional cavity portions. It is also within the scope of the invention to have housing walls that are operatively interconnected but not necessarily integrally connected so long as opposed walls are affixed with respect to each other. One advantage in the design of the device of the instant invention is the potential for utilizing a "rail" technique of undetermined length having an equally undetermined number of openings and connector wafers (or other electronic devices) inserted into the device which in turn may plug into wire-wrappable post connectors or other connector products of appropriate design. Specifically, it is possible to have a housing having operatively interconnected internal common walls to define any number of cavities having respective opposed and parallel walls required to accommodate connector wafers such as 16 and 18 or the like for the purpose of mating the conductor wafers with required interface units.

Interface unit 20 typically contains a plurality electrical contacts 28 arranged in a grid-like fashion. In the case of an aircraft wiring scheme, each of these contacts 28 is associated with a specific function of the aircraft. This design scheme is standardized in the industry by commercial and military specification so that electronic components from various aircraft may be interchanged.

In the past, the standardization of the interface unit required a labor-intensive wiring scheme of individual wires and contacts. An improvement to the individual round wire and contact scheme was the use of flat conductor cable construction and conductor wafers such as 16 and 18. The instant invention allows the effective use of such conductor wafers with individual round wires or flat conductor cables to create a mass connector assembly which accommodates various wafer sizes and insert positions. The guidance and retention device 10 of the instant invention comprises a housing 12 and at least one pair of wafer retention members 14 arranged in opposed relationship so as to guide and retain a plurality of conductor wafers independent of each other therebetween.

Cavity 24 of housing 12 will, for example, as shown, accommodate, in the alternative, four (two pair) or six (three pair) of the wafer retention members 14 as clearly shown in FIG. 1. Cavity 24 shows one such wafer retention member 14 removably secured to the common housing wall 26. Another wafer retention member would be removably secured at 30, opposite to member 14. It can be seen that conductor wafer 18 would be guided between these members and secured thereby with respect to the housing 12. It should be appreciated, with reference to FIG. 4, that five such conductor wafers may be so accommodated by one pair of wafer retention members 14, as will be discussed further later. The number of wafers to be retained and the requisite number of guidance portions on the wafer retention members is a matter of design choice. Cavity 24 will accommodate one additional pair of wafer retention members 14 to guide and secure a total of ten such conductor wafers 18, shown to be disposed generally in a horizontal plane with respect to housing 12.

Cavity 22 is shown to be identical to cavity 24. In this cavity, wafer retention members 14 are shown to be releasably connected to the housing 12 in a horizontal plane, the cavity accommodating three pairs of members 14 to guide and secure a total of fifteen conductor wafers 16 in the vertical plane. It is within the scope of the invention to provide the housing 12 having individual cavities having any number of pairs of wafer retention members as desired to mate conductor wafers with a required interface unit.

Housing 12 containing members 14 may be secured with respect to interface unit 20 by conventional fastener means such as machine screws 32. Once secured, wafers 16 and/or 18 may be inserted and retained by the retention portion of members 14 or may be removed by insertion of probes 49 of tool 50 between wafer and member 14 until the retention portion of member 14 is overcome. Once free, the wafer(s) can be removed. Thus it can be seen that individual conductor wafers 16 and 18 may be easily removed independent of each other without disturbing the mechanical and electrical interconnection of other conductor wafers with the interface unit.

Figure 2:
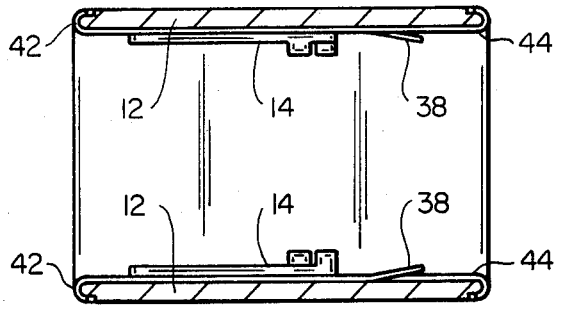
FIG. 2 is a full section view of the device taken along section lines 2—2 in FIG. 1, showing opposed wafer retention members releasably connected to opposed walls of the housing of the instant invention.
Figure 3:
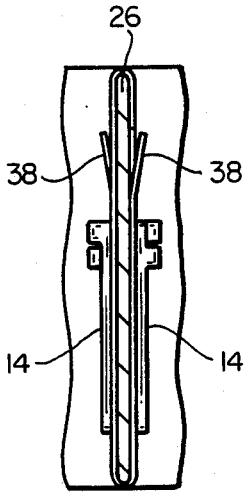
FIG. 3 is a cross-sectional view taken along section lines 3—3 in FIG. 1, showing the back-to-back assembly of wafer retention members on a common housing wall.
Figure 4:
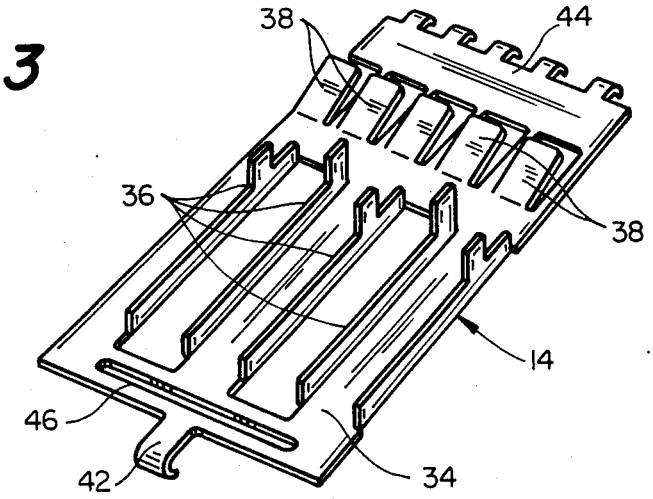
FIG. 4 is a perspective view of a single wafer retention member of the instant invention.

FIGS. 2, 3 and 4 illustrate the unique wafer retention members 14 of the instant invention. As best seen in FIG. 4, wafer retention member 14 comprises a body portion 34 having wafer guidance portions 36 and retention portions 38. Wafer retention portions 38 are complementary to the extended wafer retention boss 40 of the conductor wafers 16 and 18, as can be more clearly seen in FIG. 1. Each wafer retention portion 38 is shown to be an inwardly projecting spring-like clip which allows movement of a wafer retention boss for insertion and which may be bent back by insertion of the removal tool to remove the wafer. It is within the scope of the invention to reverse the clip and boss arrangement and have a clip on the wafer and a boss comprise the wafer retention portion 38. Guidance portions 36 are spaced so that individual conductor wafers 16, 18 may slide therebetween, allowing for independent insertion and removal of wafer 16 and 18. Wafer retention boss 40 is approximately 80% of the wafer width and has a height and thickness to withstand loads normally associated with removable contacts. The wafer material is preferably polyarylene, having properties to prevent chipping and deformation under load.

Wafer retention member 14 further includes upper hold-down tab 42 and lower hold-down tab 44 to releasably connect the members to the housing walls. The upper hold-down tab 42 incorporates a spring member 46 which allows tab 42 to resiliently extend and grip a portion of the housing. FIG. 2 illustrates a pair of opposed members14 having lower hold-down tabs 44 hooked around the outside walls of housing 12. Upper hold-down tab 42 may be extended due to spring member 46 to hook over the other end of the wall of the housing 12 to releasably connect the wafer retention members 14 with respect to the housing 12. This clip member is made from berylium copper alloy 172 and heat-treated to a tensile strength of 180,000 psi. This material permits thin but strong guidance portions 36, retention portions 38 and tabs 42 and 44. Of course these features may be obtained by other means or materials but may not have the same strength or versatility.

FIG. 1 illustrates how the wafer removal tool 50 inserts between the retention portion 38 and the wafer retention boss 40 and releases the wafer. The tool probes are shown split to pass over the cover seal (not shown) and slide between the guidance portions 36 and the wafer 16 or 18 until they stop on boss 40. The thickness of the probes 49 is adequate to push aside the retention portion 38, freeing the wafer. A tool 50 is required to be inserted into both sides of the retention member (preferably simultaneously) to fully release the wafer.

FIG. 3 illustrates how wafer retention members 14 may be releasably connected to a common housing wall 26 in back-to-back fashion. In such an embodiment, the upper hold-down tabs 42 and the lower hold-down tabs 44 are slightly symmetrically offset with respect to each other so that they may exist in side-by-side relationship, preferably in a common notch such as 48 as seen in FIG. 1.

The invention may be embodied in other specific forms, not departing from the spirit or central characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A guidance and retention device comprising:

a housing having an opening therethrough and having first and secoind operatively interconnected opposed and generally parallel walls; and at least one pair of wafer retention members located within said opening, one member releasably connected to said firs opposed wall and the other member releasably connected to said second wall, each member having a plurality of guidance portions and retention portions, said guidance portions capable of guiding conductor wafers that may be inserted in stacked relationship to each other into the housing and the retention portions capable of individually releasably securing conductor wafers within the housing; wherein each of the retention portions comprises an inwardly-projecting spring-like clip.

2. A device as in claim 1 wherein said housing includes at least one operatively interconnected internal common housing wall to define a plurality of openings therethrough, said openings having respective opposed and parallel walls to which wafer retention members may be secured.

3. A device as in claim 2 wherein each of the housing walls accommodates a plurality of wafer retention members.

4. A device as in claim 1 wherein said wafer retention members are identical to each other.

5. A device as in claim 4 wherein the housing further includes third and fourth operatively interconnected opposed and parallel walls, said walls being generally perpendicular to the first and second walls to define a rectangular opening, said wafer retention members being releasable from said first and second walls and connectable to said third and fourth walls to allow for reorganization of connector wafers to be inserted therein and a corresponding wiring array.

6. A device as in claim 5 wherein said housing includes at least one operative interconnected internal common housing wall to define a plurality of openings therethrough, said openings having respective opposed parallel walls to which wafer retention members may be secured.

7. A device as in claim 6 wherein each of the housing walls accommodates a plurality of wafer retention members.

8. A device as in claim 4 wherein the wafer retention members include upper and lower hold-down tabs to removably secure the members to walls of the housing.

9. A device as in claim 8 wherein one of the hold-down tabs further includes a spring member to allow the tab to resiliently extend to grip a portion of the housing.

10. A device as in claim 9 wherein the tabs are symmetrically offset so that they may be connected to a common wall in back-to-back fashion.

11. A connector assembly comprising:

at least one connector wafer, said wafer being generally flat, having a plurality of axially extending contacts contained therein and having a pair of extended wafer retention bosses;

a housing having an opening therethrough and having first and second operatively interconnected opposed and generally parallel walls;

at least one pair of wafer retention members located within said opening, one member releasably connected to said first opposed wall and the other member releasably connected to said second wall, each member having a plurality of guidance portions and having wafer retention portions wherein each of the retention portions comprise an inwardly-projecting spring-like clip complementary to each of said wafer retention bosses, said wafer(s) releasably secured within said housing between said members, guided by said guidance portions and retained by said retention portions.

12. An assembly as in claim 11 further including an interface unit having a plurality of contacts, the contacts of said wafer mating with the contacts of said interface unit.

13. An assembly as in claim 11 wherein said housing further includes third and fourth operatively interconnected opposed and parallel walls, said walls being generally perpendicular to the first and second walls to define a rectangular opening, said wafer retention members being releasable from said first and second walls and connectable to said third and fourth walls to allow reorganization of a plurality of wafers inserted therein.

14. An assembly as in claim 13 wherein each of the housing walls accommodates a plurality of wafer retention members.

15. An assembly as in claim 11 wherein said housing includes at least one operatively interconnected internal common wall to define a plurality of openings therethrough, said openings having respective opposed and parallel walls to which wafer retention members may be secured.

16. An assembly as in claim 15 wherein each of the housing walls accommodates a plurality of wafer retention members.

17. An assembly as in claim 11 further including a plurality of electrical conductors connected to said connector wafer.

18. An assembly as in claim 17 wherein said conductors comprise a flat conductor cable.

19. An assembly as in claim 17 wherein said conductors comprise individual round wires.

20. An assembly as in claim 19 wherein said conductors also include flat conductor cable.

* * * * *